US008182196B2

(12) United States Patent
Freed

(10) Patent No.: US 8,182,196 B2
(45) Date of Patent: May 22, 2012

(54) MODULAR POUCH TRANSFER SYSTEM

(75) Inventor: Frederick Freed, North Port, FL (US)

(73) Assignee: KHS GmbH, Dortmund (DE)

( * ) Notice: Subject to any disclaimer, the term of this patent is extended or adjusted under 35 U.S.C. 154(b) by 494 days.

(21) Appl. No.: 12/426,315

(22) Filed: Apr. 20, 2009

(65) Prior Publication Data

US 2010/0266372 A1 Oct. 21, 2010

(51) Int. Cl.
*B66C 1/00* (2006.01)

(52) U.S. Cl. ..... 414/729; 198/750.11

(58) Field of Classification Search ..... 414/680, 414/729, 733, 738, 739, 917; 198/750.11
See application file for complete search history.

(56) References Cited

U.S. PATENT DOCUMENTS 4,412,778 A * 11/1983 Wenz ..... 414/733
4,740,134 A * 4/1988 Dixon ..... 414/733

* cited by examiner

*Primary Examiner* — Donald Underwood
(74) *Attorney, Agent, or Firm* — Andrew Wilford

(57) ABSTRACT

The invention relates to a modular pouch transfer system, in which a gripper mount bar is rigidly mounted an drive arms, which are driven by driving means and mounted to them such that gripper means moves along a circular path.
With the continued rotational cycle in one direction there is no reversal of direction reducing stress on the drive components and gears, providing smoother and more reliable operation. The motion at the transfer where the pouch is loaded into the bag clamp is near vertical allowing for the height of the pouch in the bag clamp to be easily adjusted for alteration of pouch height in the bag clamps during active machine operation. This reduces the need for other methods to adjust the pouch height by other means. The transfer gripper means opening and closing occurs during the rotational cycle. There is no stopping of the assembly during the clamping cycle to pick up the pouch as it occurs on the fly, but there is a slight pause to allow the bag clamp grippers to close on the presented pouch before the transfer continues its cycle.

8 Claims, 3 Drawing Sheets

MODULAR POUCH TRANSFER SYSTEM

FIELD OF THE INVENTION

The invention relates to pouch handling machines in which a pouch needs to be transferred from a one section to another section. For example the pouch needs to be transferred from a forming section or from a pre-made pouch handler into a pouch clamping conveyor to be manipulated thru downstream operations such as opening, filling and sealing. The most reliable handling method is to use a gripper to reliably retain the pouch while transferring from the loading area to the conveyor system.

The ability to transfer pouches requires that the gripper is open at the pouch pick-up area, closes on the pouch, transfers the pouch to the conveyor area, open the jaws and reset during one machine cycle. This has to be accomplished without interfering with the new pouch being delivered to the pick-up area or the transferred pouch moving out in the pouch conveyor.

OBJECT OF THE INVENTION

The general aim of the present invention is to provide a new and improved transfer system having no reversal of direction so that stress on the drive components and gears is reduced, whereby smoother and more reliable operation are provided.

SUMMARY OF THE INVENTION

According to the invention, the transfer system comprises driving means driving two drive arms, whereby the drive arms extend parallel to each other. The assembly also comprises a gripper mount bar mounted to the drive arms, whereby the gripper mount bar comprises gripper means, which moves along a circular path, if the gears of the driving means rotate.

The driving means comprising at least motor means and a gearbox. The motor can be designed as a servo drive motor, without limiting the scope of the invention to this preferred embodiment. Further the gearbox comprises a main drive gear, two transfer gears and two output gears. Each gear is a toothed gear, so that the main drive gear drives the transfer gears, which in turn each drives the corresponding output gear. The output gears are rigidly mounted to drive shafts respectively, which rotate in the same direction as the main gear. In a further embodiment a capable belt drive can be implemented instead of the toothed gear drive, whereby the belt drive is driven by the motor means and whereby the belt drive drives two output elements, which in turn are mounted to drive shafts.

The drive arms are mounted appropriately onto the drive shafts. Preferably the drive arms are clamp mounted onto the drive shafts, whereby other capable connection types can be used in order to cause a torque proof connection of the drive arms to the drive shafts.

Advantageously the gripper mount bar is designed in a T-shape, comprising a base bar and a center bar. The base bar is mounted on two bearing mounts to the drive arms such, that the lower end of the center bar extends downwards when the drive arms cause the moving of the gripper means along the circular path. The gripper means are mounted to the lower end of the center bar opposite to the base bar.

By driving the main drive gear by the motor means, the output gears rotate the drive shafts, causing the gripper mount bar moving along the circular path, preferably counter-clockwise, whereby clockwise rotation is possible too, depending on the rotational direction of the output shaft of the motor means, and depending on the conveying direction of the pouches.

With the continued rotational cycle in one direction there is no reversal of direction reducing stress on the drive components and gears, providing smoother and more reliable operation. The transfer gripper opening and closing occurs during the rotational cycle. There is no stopping of the assembly during the clamping cycle to pick up the pouch as it occurs on the fly, but there is a slight pause to allow the bag clamp grippers to close on the presented pouch before the transfer continues its cycle.

The modular pouch transfer system according to the invention advantageously uses a gear driven crank motion that cycles continuously with the motion keeping the gripper means clear of pouches at the pick-up area and also at the pouch conveyor.

This and other objects and advantages of the invention will become more apparent form the following detailed description when taken in conjunction with the accompanying drawings.

DETAILED DESCRIPTION OF THE PREFERRED EMBODIMENT

On not in detail described pouch handling machines the pouch needs to be transferred from the forming section or from the pre-made pouch handler into the pouch clamping conveyor to be manipulated thru downstream operations such as opening, filling and sealing. The invention relates to a pouch transfer system which is described in detail.

Figure 1:
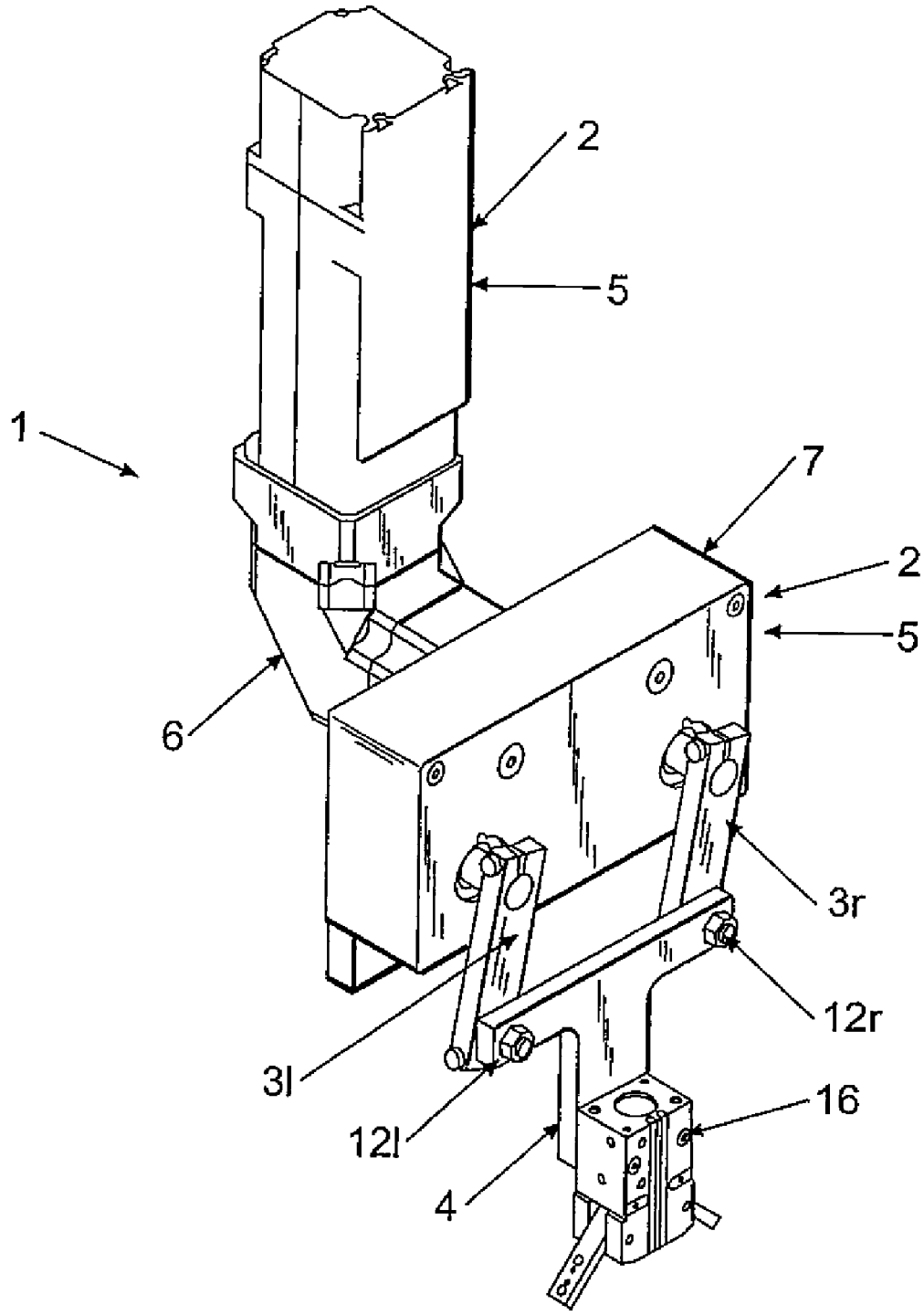
FIG. 1 is a perspective view on a modular pouch transfer system.

FIG. 1 shows a modular pouch transfer system 1, which can be called as a modular transfer assembly 1, too. The pouch transfer system 1 comprises driving means 2 driving two drive arms 3*l*, 3*r*. The drive arms 3*l*, 3*r* extend parallel to each other. A gripper mount bar 4 is mounted to the drive arms 3*l*, 3*r*.

The driving means 2 comprises motor means 5 and a gear box 6. The motor means 5 is designed as a servo drive motor for example. The output shaft of the motor means 5 drives the right angle gear box 6. The gear box 6 comprises drive gears and drive components which are housed by a box frame 7, keeping the drive gears and the drive components protected from dust a debris or the like allowing the unit to operate in dirty environments.

Figure 2:
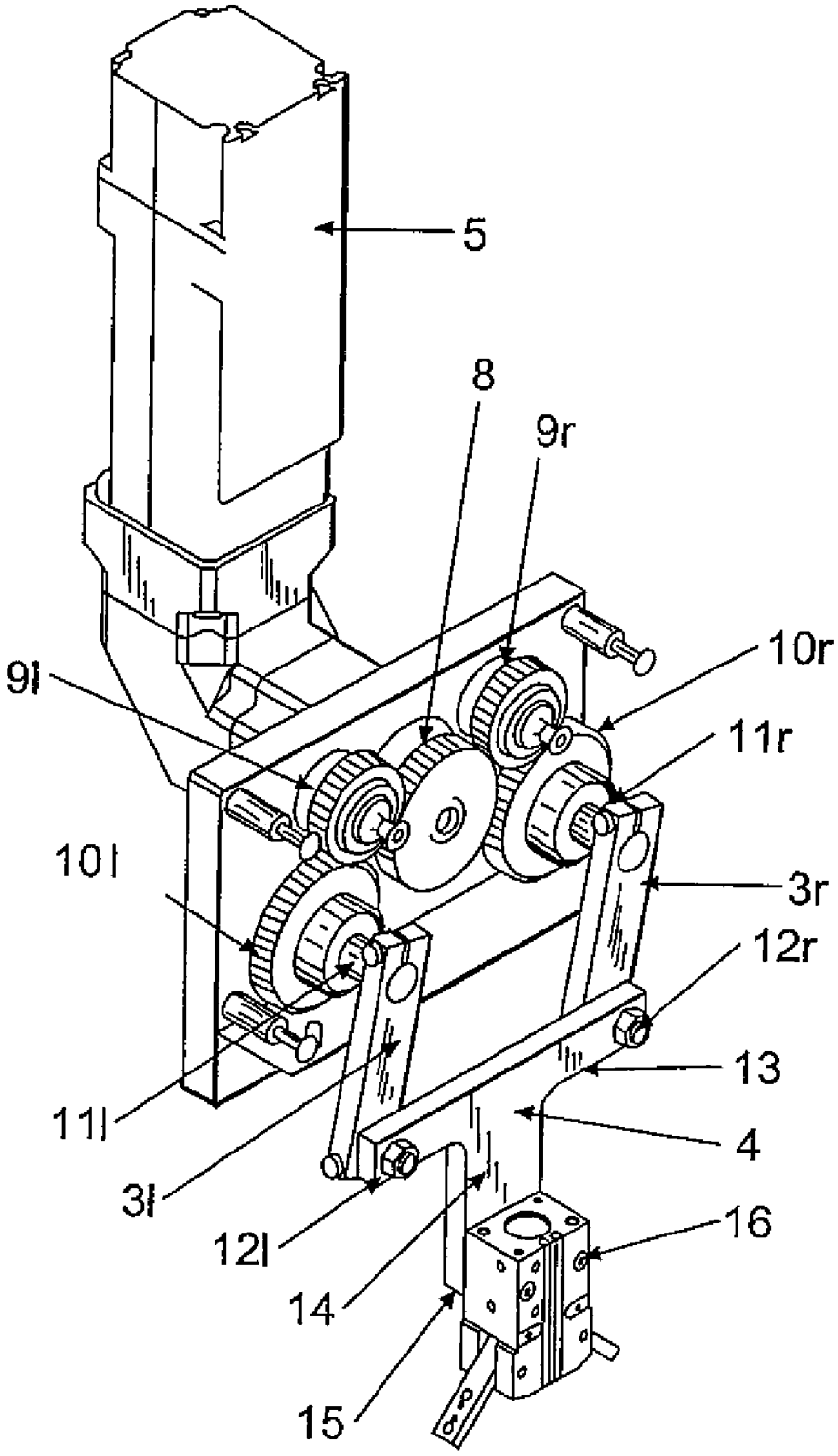
FIG. 2 is a perspective view on a modular pouch transfer system without a box frame to show the inside of a gear box.

FIG. 2 shows the gear box 6 without the box frame for better showing the inside of the gear box 6.

As one can see in FIG. 2 the output shaft of the motor means 5 drives a main drive gear 8. The main drive gear 8 is mounted on the output shaft. Further there is a pair of transfer gears 9*l*, 9*r* and output gears 10*l*, 10*r*, respectively. The reference l and r describe the left and right side according to the plane of view and relating to the main gear 8.

The main drive gear 8 drives each of the transfer gear 9*l* and 9*r*. The left transfer gear 9*l* drives in turn the output gear 10*l*. The right transfer gear 9*r* drives in turn the output gear 10*r*.

The output gears 10*l* and 10*r* are rigidly mounted to drive shafts 11*l* and 11*r* respectively.

The drive arms 3*l* and 3*r* are clamp mounted onto the drive shafts 11*l* and 11*r*, whereby the drive arms 3*l*, 3*r* extend parallel with each other.

The gripper mount bar 4 is mounted on two bearing mounts 12*l*, 12*r* to the drive arms 3*l*, 3*r*, acting as a parallelogram as the gears rotate. The gripper mount bar 4 is designed in a T-shape, comprising a base bar 13 and a center bar 14. The center bar 14 extends perpendicular from the base bar 13 and has a lower end 15. In the preferred embodiment the base bar 13 is mounted on the bearing mounts 12*l*, 12*r* to the drive arms 3*l*, 3*r*. At the lower end 15 of the center bar 14 gripper means 16 are mounted to the center bar 14.

This advantage design moves the gripper means 16 in rotary motion offset from the gear box motion.

Figure 3:
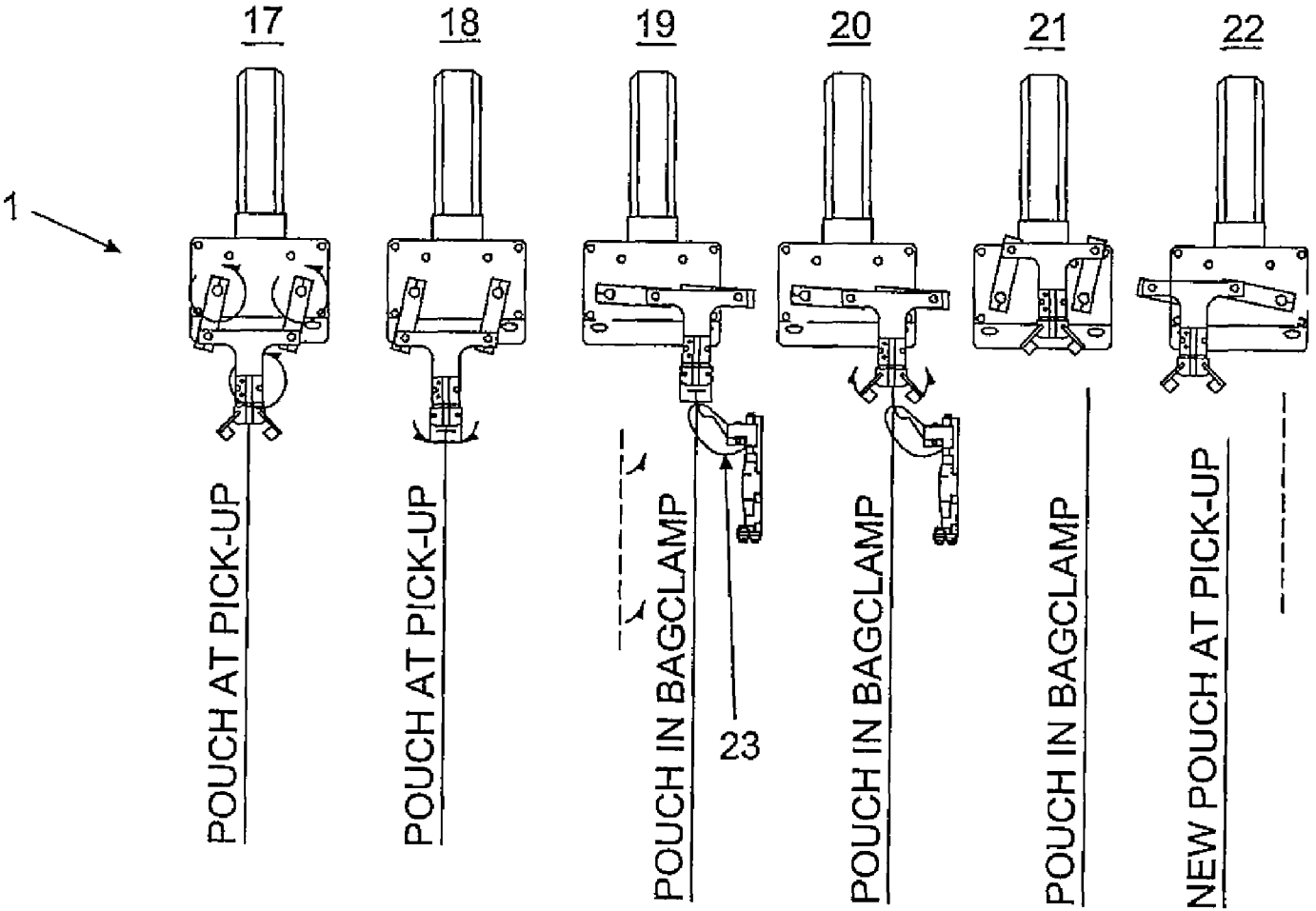
FIG. 3 shows the rotational moving of the gripper means from the pick-up area to the bag clamp and back to the pick up area in the interaction with bag clamps step-by-step.

As one can see in FIG. 3 the operational cycle (step 17 to 22) starts with the modular transfer assembly 1 positioned with the gripper means 16 open and ready to accept a pouch presented in the pouch pick-up location (step 17).

As the pouch is presented the gripper means 16 closes on the pouch and begins to move along a circular path, preferably counter-clockwise (step 18).

As the pouch moves into the pouch conveyor area the bag clamp 23 awaits in dwell (step 19). As soon as the gripper means clears the pick-up location the next pouch can begin to be presented for the next cycle.

The gripper means moves the pouch into the bag clamp jaws which close on the pouch. As this occurs the transfer gripper means 16 opens allowing the pouch to remain in the bag clamp (step 20).

The modular transfer assembly 1 continues to rotate preferably counter-clockwise moving away from the pouch in the bag clamp (step 21). As soon as the gripper means 16 is clear of the bag clamp area the bag clamp 23 can index away from the load station.

The modular gripper means 16 continues to rotate around preferably counter-clockwise and returns to the pick-up location (step 22).

With the continued rotational cycle in one direction there is no reversal of direction reducing stress on the drive components and gears, providing smoother and more reliable operation. The motion at the transfer where the pouch is loaded into the bag clamp is near vertical allowing for the height of the pouch in the bag clamp to be easily adjusted for alteration of pouch height in the bag clamps during active machine operation. This reduces the need for other methods to adjust the pouch height by other means. The transfer gripper means 16 opening and closing occurs during the rotational cycle. There is no stopping of the assembly during the clamping cycle to pick up the pouch as it occurs on the fly, but there is a slight pause to allow the bag clamp grippers to close on the presented pouch before the transfer continues its cycle.

REFERENCE

1 Modular transfer system
2 driving means
3 drive arms (r, l)
4 gripper mount bar
5 motor means
6 gear box
7 box frame
8 main drive gear
9 transfer gear (r,l)
10 output gear (r,l)
11 drive shafts (r,l)
12 bearing mounts (r,l)
13 base bar of 4
14 center bar of 4
15 lower end of 14
16 gripper means
17-22 steps
23 bag clamp

I claim:

1. A transfer system for transferring pouches from one section to another section of a pouching machine, the transfer system comprising:

driving means including a motor having an output shaft and a gearbox having a main drive gear mounted on the shaft, two transfer gears driven by the main gear, and two respective output gears driven by the transfer gears for driving two drive arms that extend parallel to each other; and a gripper mount bar mounted on the drive arms and comprising gripper means that moves along a circular path.

2. The transfer system according to claim 1 wherein the motor is a servo drive motor.

3. The transfer system according to claim 1 wherein the output gears are rigidly mounted to drive shafts that turn in the same direction as the main drive gear.

4. The transfer system according to claim 3 wherein the drive arms are mounted on the drive shafts parallel with each other.

5. The transfer system according to claim 1 wherein the gripper mount bar is mounted via two bearing mounts to the drive arms.

6. The transfer system according to claim 1 wherein the gripper means moves counter-clockwise on the circular path.

7. The transfer system according to claim 1 wherein the gripper means moves clockwise on the circular path.

8. In a pouching machine, a transfer system for transferring pouches from one section to another section of the pouching machine, the transfer system comprising:

driving means driving two drive arms that extend parallel to each other, a gripper mount bar mounted on the drive arms and provided with gripper means movable along a circular path, and control means for operating the gripper means such that the gripper means is opened to accept a pouch presented in a pouch pick-up location, closes on the pouch and begin to move along the circular path, transfers the pouch along the circular path into a pouch conveyor area in which a bag clamp awaits in dwell, moves the pouch into the bag clamp which closes on the pouch whereby whereupon the gripper means opens to allow the pouch to remain in the bag clamp, moves along the circular path away from the pouch clamped in the bag clamp, and continues moving along the circular path returning to the pick-up location.

* * * * *